United States Patent [19]

Wedding et al.

[11] 3,978,590

[45] Sept. 7, 1976

[54] SIGHTING DEVICE FOR LUMINAIRE POSITIONING

[75] Inventors: William Ray Wedding, Southaven, Miss.; John David Kiss, Memphis, Tenn.

[73] Assignee: International Telephone and Telegraph Corporation, New York, N.Y.

[22] Filed: Aug. 29, 1974

[21] Appl. No.: 501,794

[52] U.S. Cl. ..... 33/263; 33/277; 33/279; 240/25; 240/44.26

[51] Int. Cl.[2] ..... F21S 1/10; F21V 19/02

[58] Field of Search ..... 240/44.26, 25; 33/263, 33/276, 277, 278, 279, 280

[56] References Cited

UNITED STATES PATENTS

| | | | |
|---|---|---|---|
| 1,307,441 | 6/1919 | Frensdorf | 33/254 |
| 2,017,849 | 10/1935 | Blee et al. | 240/44.26 |
| 2,806,288 | 9/1957 | Sarvis | 33/254 |
| 2,859,333 | 11/1958 | Burliuk et al. | 240/44.26 |
| 3,385,258 | 5/1968 | Curtin et al. | 240/25 X |
| 3,714,415 | 1/1973 | Stephensen | 240/44.26 |

*Primary Examiner*—Richard E. Aegerter
*Assistant Examiner*—Steven L. Stephan
*Attorney, Agent, or Firm*—James B. Raden; Marvin M. Chaban

[57] ABSTRACT

Disclosed is a device for facilitating the calibration and setting of the inclination angle of a luminaire by sighting from the rear of the luminaire to a set of points such as the opposite curb of a roadway. The device may be placed on or permanently secured to the luminaire and is settable according to a derived calibrated table, either empirically derived or calculated, based on such factors as pole height, distance of pole from highway, width of the roadway, and the like.

5 Claims, 5 Drawing Figures

SIGHTING DEVICE FOR LUMINAIRE POSITIONING

BACKGROUND OF THE INVENTION

CROSS REFERENCE TO RELATED APPLICATION

In copending application Ser. No. 480,951, filed June 19, 1974 — of Messrs. Moore, Kiss and Dean, entitled "Luminaire with Mounting and Adjustment Structure", there is shown a luminaire designed to be set back from a roadway or area to be illuminated.

DESCRIPTION OF THE PRIOR ART

In the above-noted application, alignable notches were provided in the sides of the luminaire to provide a sighting to aim or set the orientation of the luminaire relative to the area to be illuminated. Adjusting means were provided to adjust the angle of inclination of the luminaire to the proper position.

SUMMARY OF THE INVENTION

The present invention provides a mountable sighting device for use on a luminaire to calibrate and set the inclination of that luminaire. The present device includes an adjustable sighting pointer, a chart or sighting indicator for positioning the pointer, the pointer having a sighting wing for each side. The sighting wings are alignable with the notches in the luminaire housing to set the adjusting members of the luminaire to the desired adjustment and inclination.

A chart is provided to assist the user or operator in setting the pointer for the geometry within which the luminaire is to function. These include the mounting height of the pole on which the luminaire is mounted, the amount of set back, the width of the area to be illuminated, the lamp type, and lamp wattage. The setting chart provides a calibrated indication at which the pointer should be set for a particular geometry or use configuration.

It is therefore an object of the invention to provide a luminaire setting control device which can be applied to a luminaire for verifying the setting of that luminaire relative to an area to be illuminated.

It is a further object of an invention to provide a sighting member for use in positioning a luminaire, the member including a setting chart and mechanism for setting the sight and holding it in place once set to enable adjustment of the luminaire to the desired position.

It is a further object of the invention to provide a chart for determining a calibration for a sighting member, the calibration being derived from the geometry of use of an adjustable lighting fixture, the resulting sighting enabling ready setting of the adjustment of the fixture.

It is a still further object of the invention to provide a calibration control for a sighting member mountable on a mounted luminaire for setting the inclination of that luminaire relative to an area to be illuminated such as a roadway.

Other objects, features and advantages of the invention will be apparent from the accompanying specification viewed in conjunction with the drawings described briefly next.

DETAILED DESCRIPTION OF THE DRAWINGS

Figure 1:
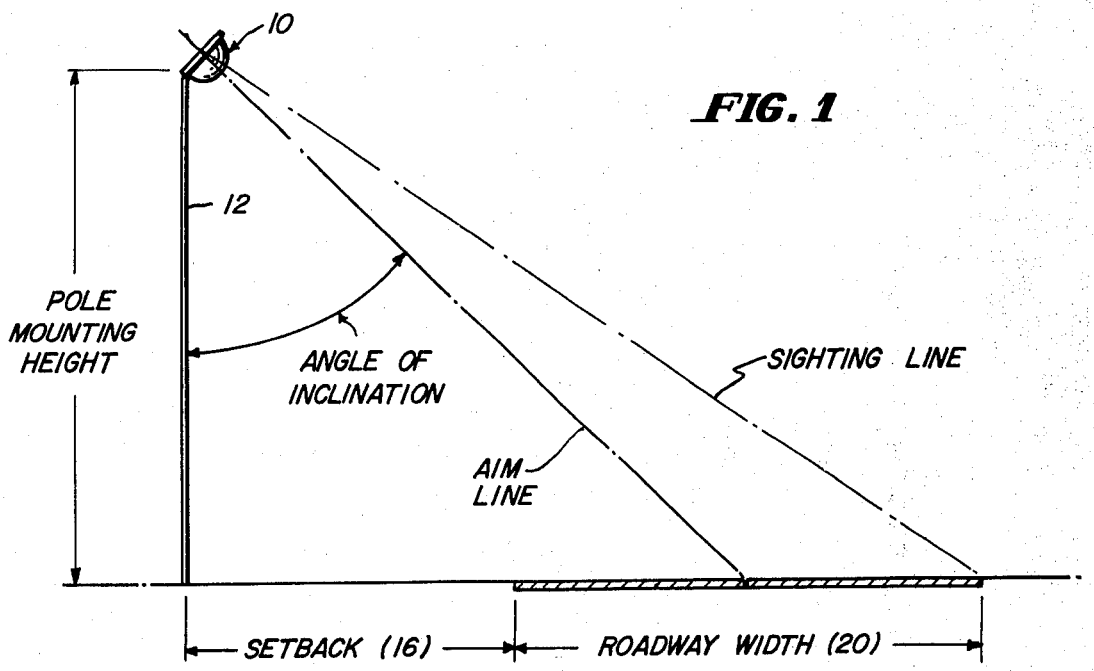
FIG. 1 is a schematic drawing of the geometry of mounting of a luminaire relative to a road to be illuminated.

In FIG. 1, we show a luminaire 10 mounted on the top of a mounting structure such as pole 12 set back from a roadway 20 or other area to be illuminated, such as sports field or parking lot, a distance designated 16. The height of the pole 12 which is used may differ from use to use depending on various other considerations, such as topography, local statutes and the like. The distance of the setback 16 may also differ from location to location depending on such factors as available space considerations and topography; width of roadway 16 may differ in that, from location to location, the roadway may differ in width by usual multiples of ten or twelve depending on the number of lanes and the standards applied as to lane width.

With these variables, the inclination of the luminaire must be set following installation of the luminaire, and repair or replacement of the lighting unit. The inclination and setting may also be checked periodically, if found necessary.

One approach to setting the angle of inclination is the basic approach shown in the copending application noted previously. In that approach, a pair of spaced-apart notches are provided on each side of the luminaire casting to sight on the opposite curb of the roadway and set the angle of inclination accordingly. However, this approach is used only for one specific type of luminaire, e.g., sodium vapor, one wattage such as 400 watts, one set-back distance and one roadway width. However, it should be noted that several other combinations of conditions could also be aimed with the fixed notches by changing the point of reference from the far curb to some other convenient place on the roadway, or other area to be illuminated.

To merely set the angle of the luminaire, an inclinometer (such as used on shipboard) may be used. The inclinometer may include a calibrated scale and a chart to be read and to enable the setting. The approach shown herein comprises the use of a sighting device 30 with an adjustable pointer or the like. A calibrated scale for the pointer provides a setting control for the pointer, the setting being made according to a chart.

Figure 4:
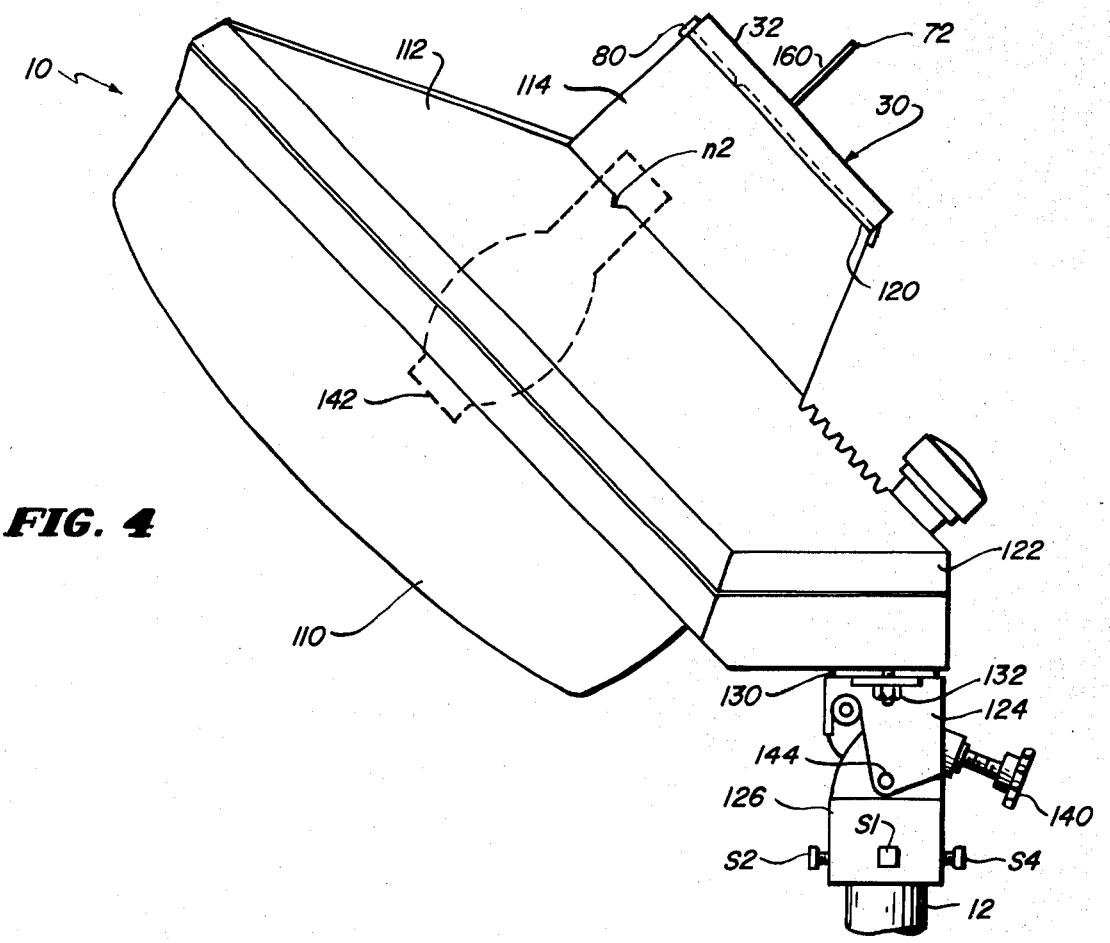
FIG. 4 is a side view in elevation of a luminaire employing our invention.
Figure 5:
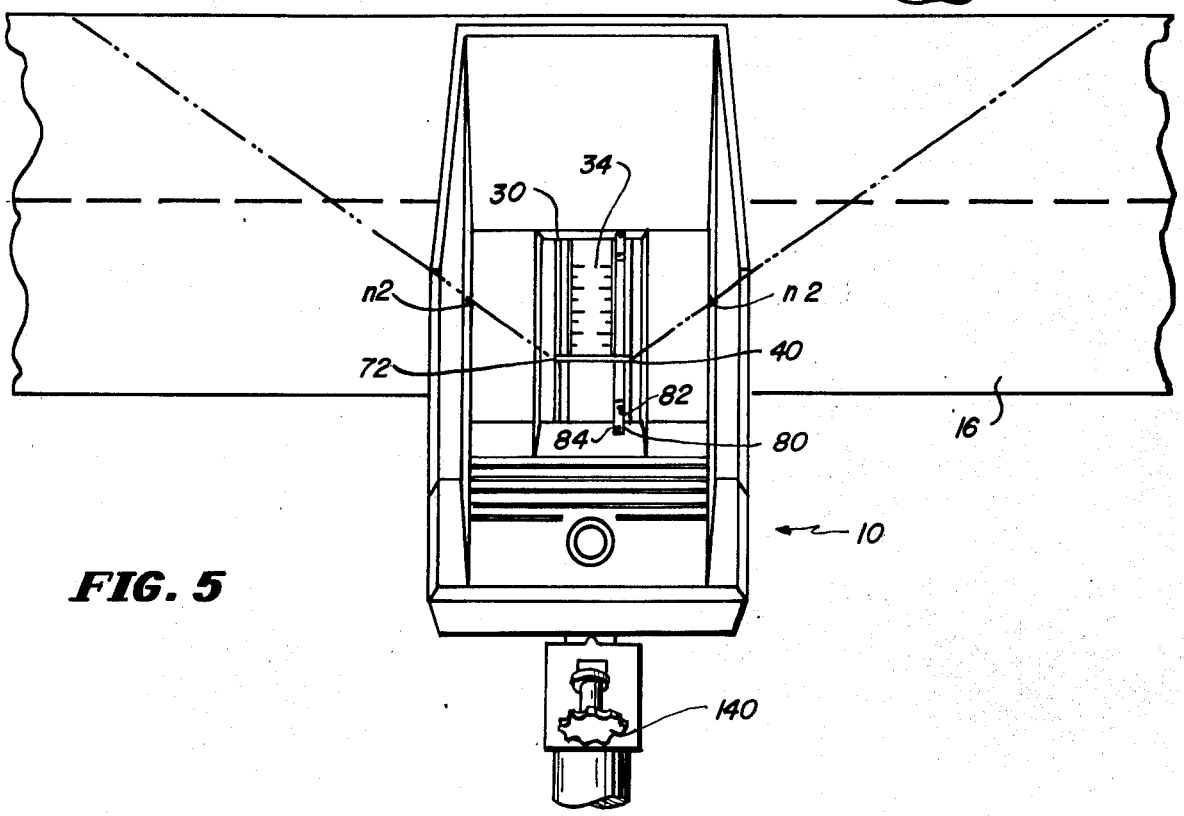
FIG. 5 is a rear view in elevation of a luminaire to which our invention is applied, as viewed against a roadway to be illuminated.

The sighting device 30 may be slipped onto a luminaire or permanently mounted thereon as desired. In FIGS. 4 and 5, we show the device 30 mounted on a luminaire of the type shown in the copending cited application. The luminaire includes inset V-shaped notches as used in the sighting process. It is clear that other fixed location members such as raised V-shaped ribs or the like could be used in place of the notches, notches having been chosen as members simple to produce and which do not protrude. Protruding members could be broken or bent but could be used with the principle shown generally herein.

Figure 2:
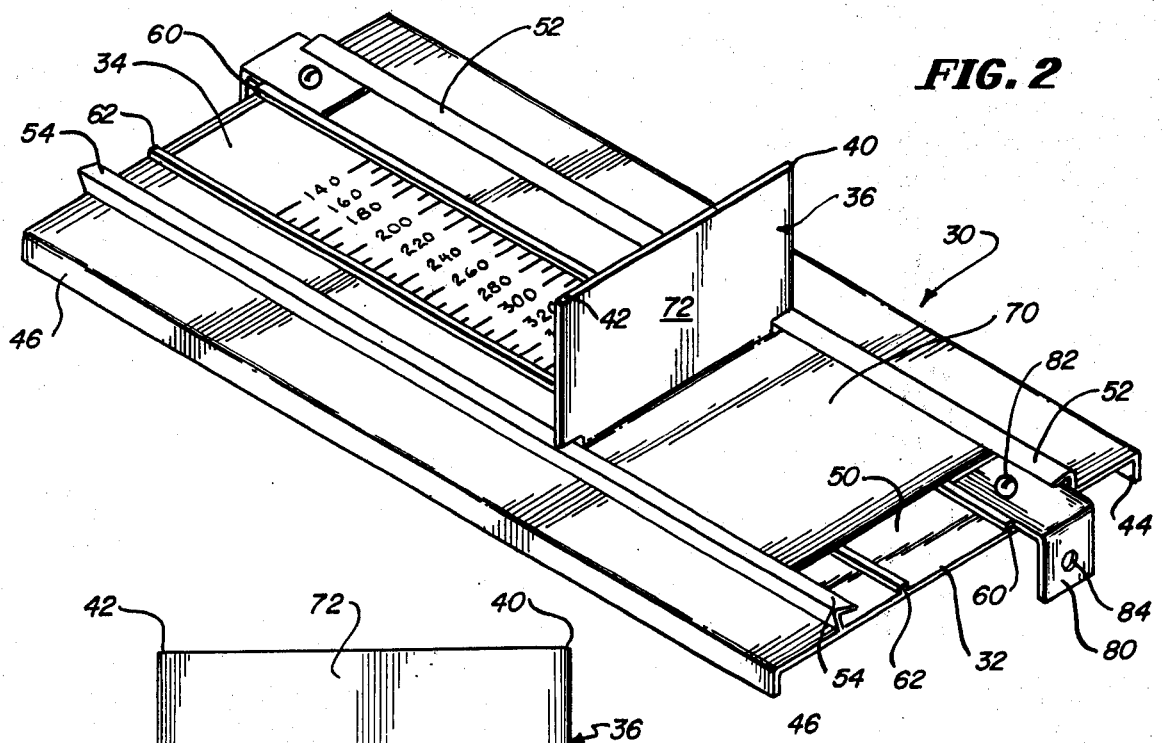
FIG. 2 is a perspective of one form of sighting device employing our invention.
Figure 3:
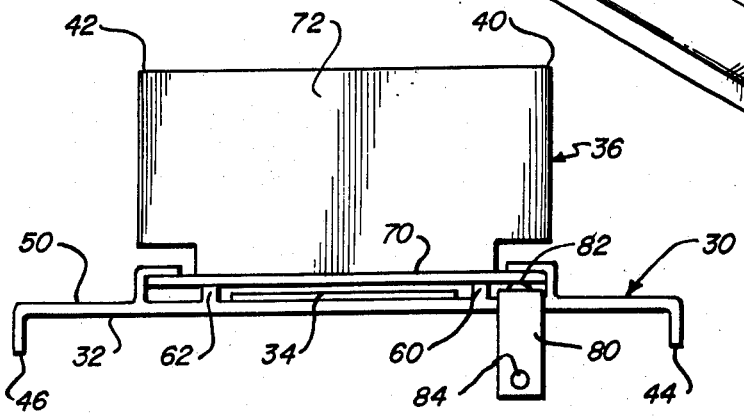
FIG. 3 is an end view of the sighting device of FIG. 2.

The device 30 as seen best in FIGS. 2 and 3 include a generally planar body 32 which fits stationarily on the luminaire in use. The body contains a calibrated scale 34 with readings successively along the length of body 32. A sliding back sight or pointer 36 constrained to sliding translatory movement relative to the body is settable relative to the body to position the sighting tips 40 and 42 accordingly.

The body 32 may be an extruded member of suitable sheet metal or plastic with downturned rim edges 44 and 46 at the lateral edges of otherwise flat undersurface (not shown). On the upper surface 50 of the body, two L-shaped or stepped confining rails 52 and 54 hold the sliding pointer 36 and confine it to longitudinal sliding movement along the surface of upstanding guides 60 and 62. These guides form the borders within which the calibrated scale 34 is mounted. The scale may be a decal or tape which is adhered against the front surface of body 32 within the area bordered by guides 60 and 62. These guides also space the pointer from contact with the scale by providing surfaces for the slider to ride across. By the spacing between the tops of guides 60 and 62 and the confining section of the rails 52 and 54, the pointer may slide freely with a fit which is sufficiently tight to hold the pointer where placed and yet allowing the pointer to be moved manually.

The sliding pointer may be fabricated of suitable sheet metal or plastic and with a slider section 70 which is essentially rectangular and fits within rails 52 and 54 and on guides 60 and 62.

Affixed to the slider section is the back sight riser section 72, this section extending preferably perpendicularly from the slider section with sighting tips 40 and 42 at the opposed upper lateral tips of the riser section. The riser has insets to enable the bearing area to cooperate with the rails to maintain the alignment of the pointer relative to the body.

At its longitudinal ends, as shown in FIGS. 2 and 3, mounting angle brackets 80 may be suitably secured at each end between a guide and rail. The brackets may be bolted or riveted to the body as shown at numeral 82 and act to confine the slider longitudinally, also acting as travel stops for the sliding pointer. The major function of the brackets is to allow the pointer to be properly oriented with the notches *n*2. For permanent mounting, a fastener opening is provided in the free leg 84 of each angle bracket to provide permanent mounting of the pointer to the luminaire, if desired. If snap-on mounting or permanent mounting is desired, the brackets should be of comparatively rigid material to properly position the brackets on the pointer. Consequently, the pointer to luminaire positioning is effected by the bracket positioning. If desired, clip members could be used in place of the brackets to provide snap-on joinder of the pointer to the luminaire.

In FIG. 4, we show in side elevation, our sighting device mounted on a luminaire 10 of the type shown in greater detail in the cited copending application. The luminaire has a translucent lens 110 covering the opening in the luminaire housing 112. The housing has a lamp mounting section 114 essentially rectangular in section. This section provides a flat rear surface 120 onto which our sighting device is mounted.

A lower section 122 of the housing 112 is mounted on a base section 124 using plural mountings and adjustments for seating the luminaire on a pole 12. First the lower base section has an essentially tubular base

126 with its bore opening sized to enable the base to rest on the pole 12. Four mounting bolts S1, S2, S3 (not shown) and S4 on the sides of the tubular base 126 secure the base to the pole in a manner enabling adjustment of the base relative to the pole and consequently, the luminaire relative to the pole.

The connection of the base to the main housing allows a side-to-side adjustment by way of the rocking engagement of the luminaire on the base-central ridge 130 (as described in the cited copending application) enabling a leveling of the luminaire relative to the roadway. This adjustment is set by bolts 132 being selectively tightened to rock the luminaire housing to a horizontal setting relative to the base and pole.

A third adjustment by way of adjusting knob 140 is used to set the angular inclination of the face of the luminaire (and lamp 142) relative to the roadway about the luminaire pivot 144.

In FIGS. 4 and 5, the device 30 is shown mounted on the rear of housing 114 essentially on surface 120. The riser section 72 is shown which may be aligned with notch *n*2 for sighting purposes.

The following portion of a chart labelled "AIMING CHART" shows how the present device would be used for a wide variety of mounting heights, set backs, road widths or areas to be illuminated for various lamp types and wattages capable of being used. The chart portion shown is for two specific lamp types and wattages. The chart shown would be extrapolated along the vertical margin for other mounting heights in the manner set out. Along the horizontal margin, the various lamp wattages and types would be set out. It is clear that the extrapolated chart covering the range of distances and the lamps would allow luminaires to be properly aimed.

AIMING CHART

| CONDITION | | | LAMP TYPE | | | |
|---|---|---|---|---|---|---|
| | | | 250 WATTS HPS | | 400 WATTS CLEAR MERC. | |
| MOUNTING HEIGHT (FT.) | SET BACK (FT.) | ROAD WIDTH (FT.) | Tilt Angle | Ref. Line | Tilt Angle | Ref. Line |
| 30 | 20 | 24 | 47.5 | 386 | 40 | 426 |
| | | 36 | 47.5 | 406 | 45 | 446 |
| | | 48 | 50.0 | 438 | 47.5 | 479 |
| | 30 | 24 | 50.0 | 353 | 47.5 | 392 |
| | | 36 | 52.5 | 388 | 52.5 | 388 |
| | | 48 | 57.5 | 364 | 55 | 403 |
| | 40 | 24 | 55.0 | 338 | 55 | 338 |
| | | 36 | 57.5 | 356 | 57.5 | 356 |
| | | 48 | 60.0 | 360 | 60 | 360 |
| | 50 | 24 | 60.0 | 309 | 57.5 | 348 |
| | | 36 | 62.5 | 315 | 60 | 354 |
| | | 48 | 65.0 | 312 | 62.5 | 350 |

The procedure by which a luminaire would be adjusted could be as follows: First, to set the luminaire pattern properly on the roadway relative to its width, the setting of the riser on scale 34 is effected, the setting determined from the chart above. The riser is moved to show the desired number on the scale beneath the vertical extent of the riser front 160.

Second, the tubular base 126 is set on the pole and the aiming of the luminaire on the roadway about the pole axis is set by tightening bolts S1–S4. In this way, the luminaire front face is essentially parallel to the roadway and compensated for road curvature, as viewed through aligned notch *n*2 and sighting tips 40 and 42.

As a third step, the side-to-side leveling of the luminaire is adjusted by rocking the luminaire on the base ridge 130 to set the side-to-side adjustment of the luminaire and place the top front surface of the luminaire parallel to the roadway as can be seen from FIG. 4. This setting is completed by tightening bolts 132 at the desired level or parallel setting. This side-to-side adjustment is used to compensate for the inclination of the roadway as it lies in front of the luminaire as viewed through aligned notch *n*2 and sighting tips 40 and 42 on respective sides of the luminaire. This form and checking and setting also compensates for poles which have not been installed accurately in a vertical sense and hence are "out-of-plumb".

As a fourth step, the angle of inclination may be set by aligning respective tips 40 and 42 with the notches *n*2 against the remote curb, edge of the roadway, or any other predetermined location. The knob 140 is rotated to set the inclination angle.

If both sides of the luminaire do not show alignment, then either the side-to-side adjustment of bolts 132 must be reset or the rotation of the luminaire about the pole axis must be reset followed by a final setting of the inclination angle, once again.

It should be noted that although the foregoing specification has been directed primarily to a roadway to be illuminated, it should be understood that this field of use has been chosen as one which is easier to explain than other fields of use for areas to be illuminated. Such other areas to which the invention may be applied are sports fields for many sports and arena parking lots, landing fields and the like.

We claim:

1. A method of setting the inclination and lateral alignment of a luminaire beam relative to an area to be illuminated, wherein the luminaire is adapted for permanent mounting a distance from the area to be illuminated on a pole of one of a plurality of heights, comprising the steps of aiming the luminaire generally toward the area to be illuminated, positioning a sighting member on a calibrated scale to a setting determined by the height of the luminaire pole mounting and the distance of the pole from the area, sighting through the sighting member along a line of sight through a fixed element along one lateral side of the luminaire to sight a point adjacent one lateral extent of the beam relative to the area, adjusting the luminaire relative to that side of the area to bring a desired predetermined point into sighting alignment, sighting along a line of sight from the member through a fixed element on the other lateral side, and adjusting said other lateral side to set a predetermined point adjacent the opposed lateral extent of the beam into sighting alignment for adjustment of that side of the luminaire.

2. A sighting device removably mountable on a luminaire adapted to illuminate an area spaced a distance from the luminaire, said luminaire including an illuminating face for projecting a beam of light therefrom directed toward the area to be illuminated, lateral sides of the luminaire bounding said face, and a housing surface enclosing the luminaire on the side remote from said face, said device including means mounting said luminaire at a fixed location at one of a predetermined distances from the area to be illuminated, means for adjusting the inclination of said luminaire on said mounting means to incline the beam and illuminate the area, said sighting device including (1) parallel spaced-apart stationary tracks disposing a rear sighting member of said device in a predetermined angular relationship relative to said illuminating face when said sighting device is mounted on said surface, (2) said sighting member manually translatable along said tracks for movement in a path parallel to said tracks, said sighting member disposed inwardly of said lateral sides of said luminaire when said device is mounted on said surface, (3) a calibrated scale defining positions of said sighting member in said path with positions on said scale for each of said predetermined distances of the luminaire from the area to be illuminated, and (4) a fixed front sighting member adjacent one of the lateral sides of said luminaire to enable visual sighting laterally outwardly from said rear sighting member across said front sighting member relative to a predetermined point adjacent to the lateral extremity of the area to determine the proper adjustment of the luminaire for projection of the beam to the area.

3. A device as claimed in claim 2 wherein said rear sighting member comprises a lateral bar including a first and a second sighting element laterally spaced along said bar, respective fixed front sighting elements on each lateral side of said luminaire for alignment with respective sighting elements on said bar to present lines of sight relative to the lateral spread of the area, and means captured within said tracks mounting said bar for forward and reverse translatory movement relative to scale to translate both sighting elements accordingly.

4. A device as claimed in claim 3, wherein said bar includes a leg section adapted to slide parallel to said surface, and in which said tracks include guide members at the lateral sides of said leg section constraining said leg section and said sighting elements to translatory motion along said surface.

5. A device as claimed in claim 2, wherein said sighting device comprises a rigid member having a section captured within said tracks and an upright extending from said section, said upright including a manually graspable wall to enable translatory movement of the device, said upright including a plurality of rear sighting elements transversely spaced along said wall, and a plurality of fixed front sighting elements on said lateral sidewalls for respective line of sight alignment with respective ones of said rear elements.

* * * * *